US005079779A

United States Patent [19]

Spector et al.

[11] Patent Number: 5,079,779

[45] Date of Patent: Jan. 14, 1992

[54] CONVERTIBLE WOMAN'S SHIRT

[76] Inventors: Donald Spector, 380 Mountain Rd., Union City, N.J. 07087; Akemi Sone, 118 Madison Ave., New York, N.Y. 10016

[21] Appl. No.: 701,802

[22] Filed: May 17, 1991

[51] Int. Cl.[5] ..... A41B 1/00

[52] U.S. Cl. ..... 2/106; 2/115

[58] Field of Search ..... 2/75, 80, 105, 106, 2/102, 103, 115, 244; D2/209, 211, 225, 226

[56] References Cited

U.S. PATENT DOCUMENTS

| | | | |
|---|---|---|---|
| 2,389,152 | 11/1945 | Keeler et al. | D2/226 |
| 2,575,791 | 11/1951 | Brown | 2/106 |
| 2,593,059 | 4/1952 | Schnurer | 2/106 X |
| 2,603,788 | 7/1952 | Page | 2/106 X |
| 4,797,954 | 1/1989 | Williams | 2/106 |
| 4,866,791 | 9/1989 | Carver et al. | 2/106 |

FOREIGN PATENT DOCUMENTS

| | | | |
|---|---|---|---|
| 311457 | 10/1933 | Italy | 2/106 |
| 408061 | 4/1934 | United Kingdom | 2/103 |

*Primary Examiner*—Werner H. Schroeder
*Assistant Examiner*—Jeanette E. Chapman
*Attorney, Agent, or Firm*—Michael Ebert

[57] ABSTRACT

A woman's shirt that is normally of hip length and is convertible into a shirt of waist length that in a first wearing mode has an underlying halter integral therewith, and in a second wearing mode an overlying halter. The shirt front is defined by left and right panels that can be buttoned together or left open, the back being of greater length to form a rear section that extends below the front. Extending across and normally covering the rear section is a fabric band whose ends are sewn to corresponding ends of the rear section and whose upper margin is joined by releasable fasteners to the lower margin of the left and right panels, the lower margin of the band being free. Complementary components of a connector are attached to the lower left and right corners of the band. To convert the shirt to the first wearing mode, the wearer releases the band from the panels, and then raises the band under the panels and over her head, thereby causing the band to yoke the neck of the wearer and to cover her bust. The complementary components of the connector are then joined together to create a halter underneath the panels. In converting the shirt to the second mode, the same procedure is followed, except that the band is raised to go over the panels and thereby create a halter that overlies the panels.

9 Claims, 3 Drawing Sheets

Fig. 1.
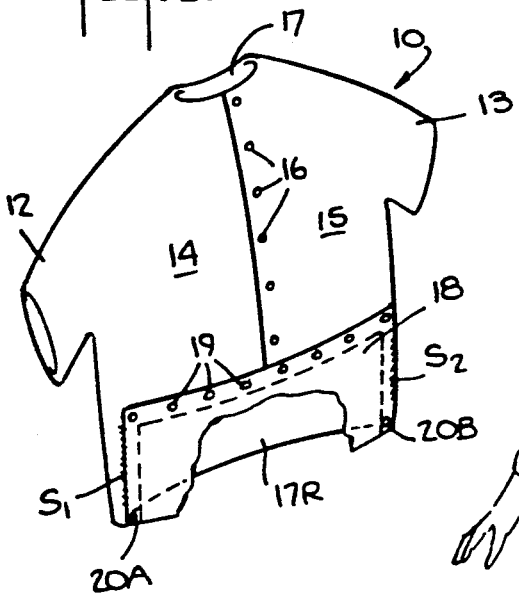
Fig. 2.
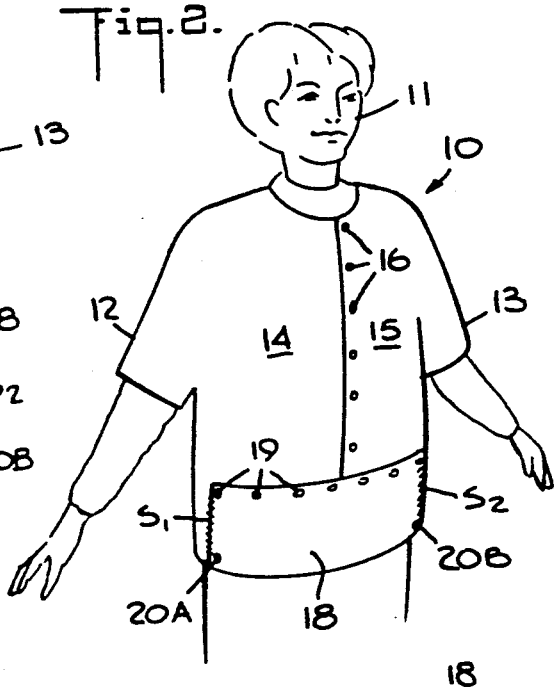
Fig. 3.
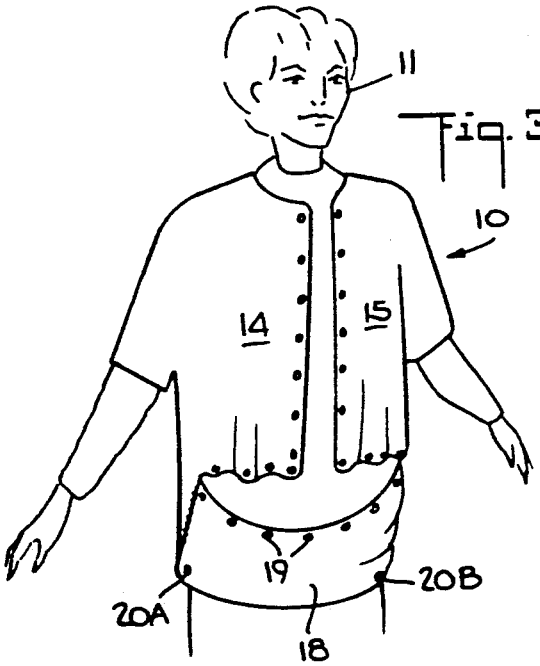
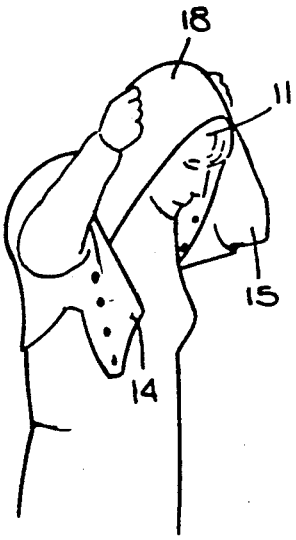
Fig. 4.
Fig. 5.
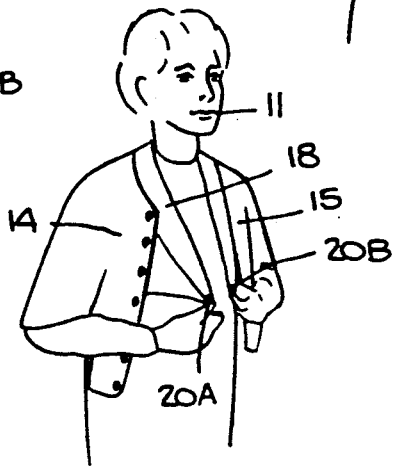

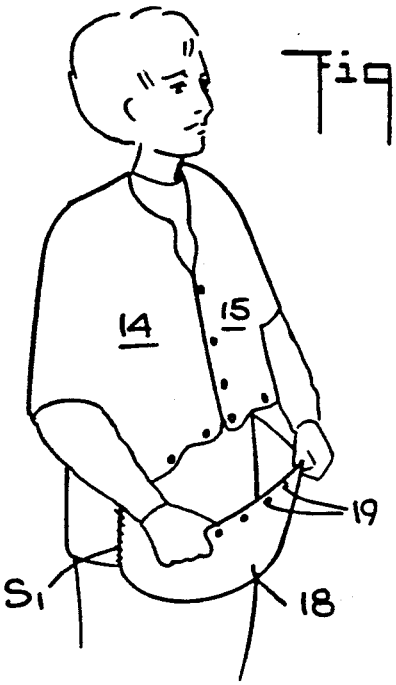
Fig. 10.
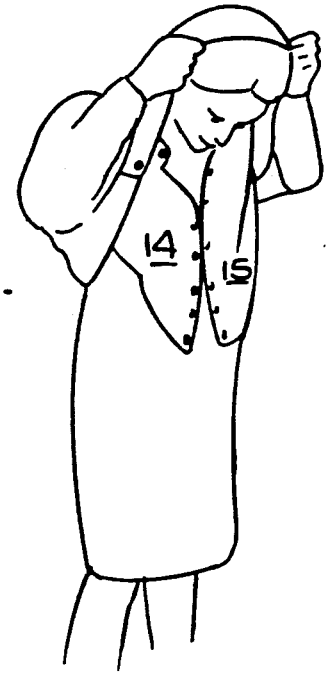
Fig. 11.
Fig. 14.
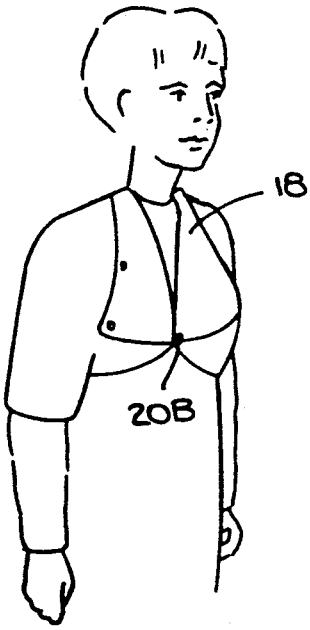
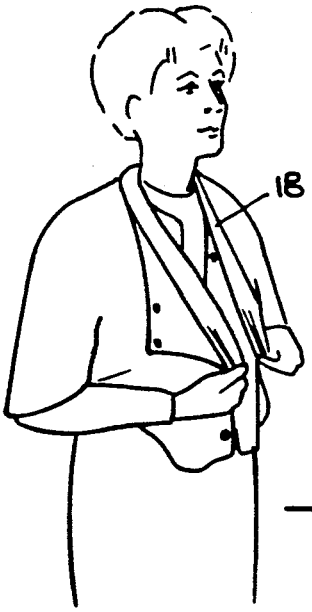
Fig. 12.
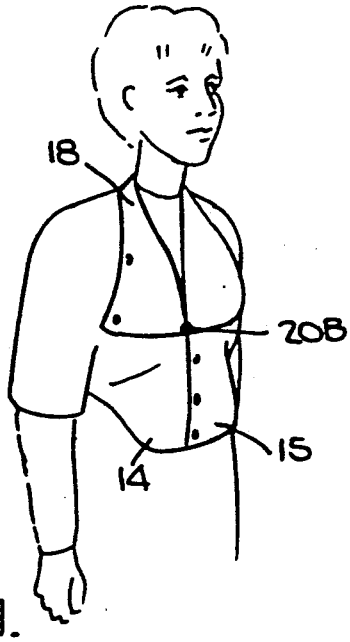
Fig. 13.

CONVERTIBLE WOMAN'S SHIRT

BACKGROUND OF INVENTION

1. Field of Invention

This invention relates generally to an article of woman's apparel that is convertible to assume different wearing modes, and more particularly to a woman's shirt which is normally of hip length and is convertible into a shirt of about waist length that in one wearing mode has an underlying halter integral therewith, and in a second wearing mode has an overlying halter.

2. Status of Prior Art

The Carver et al. U.S. Pat. No. 4,866,791 discloses a woman's sport shirt that normally functions as a waist-length, short-sleeved T-shirt. Provided on opposite sides of the hem of the shirt are complementary snap buttons. When worn, the shirt is readily convertible into a halter-like garment by raising the waist hem above the midriff, then lifting the front section of the shirt above the head and rolling it behind the neck to create a yoke joining the left and right portions of the front section which are then drawn across the bust of the wearer and interconnected by the snap buttons to form a bra-like support above the exposed midriff.

As pointed out in the Carver et al. patent, the modern woman is by no means confined to her home, and in this New Age is free to engage in a broad range of activities. She therefore requires a wardrobe that includes sportswear as well as apparel suitable for more or less formal indoor and outdoor events. Because the modern woman is often on the go and wishes to travel lightly, she seeks to simplify her wardrobe, yet she also wishes to be presentable and comfortable under changing circumstances. When involved in sports activity, her apparel for this activity must be free of restraints, whereas at a formal party, the apparel must have some measure of elegance.

In the convertible T-shirt discloses in the Carver et al. patent, the shirt is convertible into a halter that is more decorative and less casual in appearance than a T-shirt and therefore suitable for dressier occasions.

A conventional halter is a women's blouse that leaves the arms and the midriff bare, and is typically held in place by straps around the neck and across the mid section of the back. Because it affords more body exposure, it is somewhat cooler than a T-shirt. Moreover, a halter provides some degree of bust support. On the other hand, for some formal occasions a halter may be too cool a garment and have excessive exposure. What then may be called for is a short jacket to go over the halter.

Another limitation of the Carver et al. convertible T-shirt is that it is of waist length; hence when worn with slacks or a skirt, the T-shirt will not go over the slacks or the skirt. As a consequence, the junction between the hem of the T-shirt and the waist of the slacks or skirt will be exposed, and while for informal wear this is not objectionable, for more formal occasions it is desirable that the hem of the shirt overlie and conceal the waist of the skirt or slacks. Moreover, with the convertible T-shirt, in converting the shirt, all of the fabric on the front panel must be rolled or pulled over the head to provide a halter neck support that is somewhat bulky.

SUMMARY OF INVENTION

In view of the foregoing, the main object of this invention is to provide a convertible woman's shirt that can be worn as a top in combination with a bottom in the form of a skirt, slacks, shorts or bathing suit bikini, and which without being taken off is readily convertible into an article of apparel which is coordinated with the bottom being worn. This shirt may have short or long sleeves, or be sleeveless.

In the apparel field, the term "coordinate" refers to articles of clothing that are designed to be used together and to attain their effect through pleasing contrast. Thus a T-shirt can be coordinated with shorts to create a sports outfit. And a halter may be coordinated with a skirt to create an evening dress.

More specifically, an object of the invention is to provide a convertible shirt, normally of hip length, that is convertible in a first mode into a shirt of about waist length underneath which is a bust supporting halter integral with the shirt, and in a second mode to a shirt of about waist length in which the halter overlies the shirt.

A significant feature of a shirt in accordance with the invention is that its back is longer than its front to form a rear section that extends below the front and is covered by a fabric band whose ends are sewn to corresponding ends of the rear section, the band in the first and second wearing modes functioning to create a halter integral with the shirt. The band may be made of a fabric or color which contrasts with that of the shirt to provide a highly decorative and fashionable article of apparel.

Also an object of the invention is to provide a convertible shirt which simplifies the wearer's wardrobe, for the same shirt can assume apparel forms appropriate to different activities or occasions.

Briefly stated, these objects are attained in a woman's shirt that functions as a top when worn in combination with a skirt, slacks or shorts or other form of bottom. The shirt, normally of hip length, is convertible into a shirt of about waist length that in a first wearing mode has an underlying halter integral therewith, and in a second wearing mode an overlying halter. The shirt front is defined by left and right panels that can be buttoned together or left open, the back of the shirt being of greater length to form a rear section that extends below the front. Extending across and normally covering the rear section is a fabric band whose ends are sewn to corresponding ends of the rear section and whose upper margin is joined by releasable fasteners to the lower margin of the left and right panels, the lower margin of the band being free. Complementary components of a connector are attached to the lower left and right corners of the band.

To convert the shirt to the first wearing mode, the wearer releases the band from the left and right panels, and then raises the band whose ends are sewn to the ends of the rear section, under the panels and over her head, thereby causing the band to yoke the neck of the wearer and to cover her bust. The complementary components of the connector are then joined together to create a halter underneath the panels. In converting the shirt to the second mode, the same procedure is followed, except that the band is raised to go over the panels and thereby create a halter that overlies the panels.

BRIEF DESCRIPTION OF DRAWINGS

For a better understanding of the invention as well as other objects and further features thereof, reference is made to the following specification to be read in conjunction with the accompany drawings, wherein:

FIG. 1 is a perspective view of a woman's convertible shirt in accordance with the invention which is normally of hip length and includes a special band;

FIG. 2 shows a woman wearing this shirt;

FIG. 3 illustrates the first step taken by the wearer to convert the shirt into a first wearing mode;

FIG. 4 shows the second step in which the wearer raises the band after it has been released from the left and right panels of the shirt, first under these panels and then over her head and behind her neck;

FIG. 5 shows the final step in which the wearer of the shirt joins joins the components of a connector to form a halter underlying the shirt;

FIG. 10 shows the wearer of the shirt carrying out the first step of a procedure to convert the shirt into a second wearing mode;

FIG. 11 shows the second step in which the released band is raised first over the left and right panels of the shirt and then over the head and behind the neck;

FIG. 12 shows the third step in which the band is now a yoke about the neck of the wearer and covers the wearer's bust, the complementary components of the connector being joined together to complete the halter;

FIG. 13 shows the halter overlying the left and right panels of the shirt; and

FIG. 14 shows the left and right panels tucked under the halter.

DESCRIPTION OF INVENTION

Figure 7:
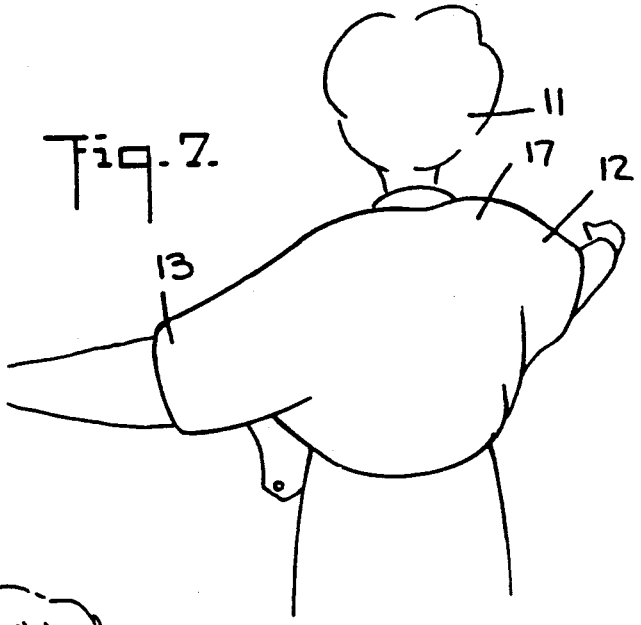
FIG. 7 shows the rear of the shirt which is now of waist length.
Figure 6:
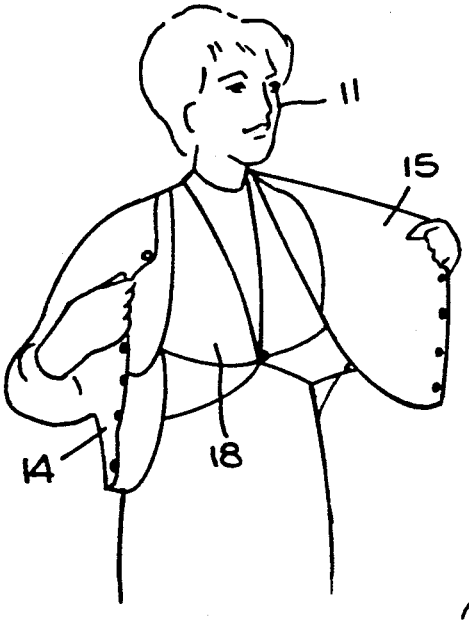
FIG. 6 shows the wearer opening the shirt front to expose the halter.

Referring now to FIGS. 1 and 2, there is shown a convertible shirt 10 in accordance with the invention, as worn by a woman 11. The shirt is normally of hip length and has a collarless, circular neck opening. The shirt is provided with short sleeves 12 and 13, and a front defined by left and right panels 14 and 15. These panels are joinable by a row of fasteners 16 that may take the form of snaps, buttons or hooks, or a Velcro fastener, whereby the front may be opened or closed. Alternatively, the shirt may be provided with a collar.

The back 17 of shirt 10 is longer than the front to provide a rear section 17R that extends below the left and right panels 14 and 15 of the front. Extending across and covering rear section 17R is a fabric band 18 whose ends are sewn by threading $S_1$ and $S_2$ to the corresponding ends of this section.

The upper margin of band 18 is joined by a row of releasable fasteners 19 to the lower margins of the left and right panels 14 and 15. These fasteners may take the form of snap fasteners, buttons or hooks, or be in the form of a zipper or a Velcro fastener.

The left and right panels 14 and 15 are of about waist length, but in combination with the band, the front is of hip length, as is the back of the shirt.

Attached to the lower left and right corners of band 18 are the complementary components 20A and 20B of a snap connector, a hook and loop connector or a button-button hole connector, the purpose of which will later be explained. The lower margin of band 18 is free, so that the shirt can be put on by slipping it over the head of the wearer in the manner of a T-shirt.

The shirt may be fabricated of cotton or other natural fibers, of synthetic fibers, a mixture of synthetic and natural fibers, or of stretch fabric. Band 18 may be made of the same material as that of the rest of the shirt and in the same color. However, since the band, when the shirt is converted, acts to create a halter, in practice band 18 may be of a color or fabric that contrasts with the fabric of the remainder of the shirt and therefore is more stylish. Thus band 10 may be made of a fabric that is bright colored and has a decorative surface, whereas the rest of the shirt may be of more subdued fabric. Band 10 may be of a stretch fabric to accommodate many sizes.

When the shirt is worn, as shown in FIG. 2, because it normally is of hip length, its hem will overlie the waist of a skirt, slacks or shorts, bikini, or whatever other bottom is being worn by the woman. In practice, the shirt may be formed with a V-neck opening rather than a circular neck opening, and it may be sleeveless or long sleeved, for neither the neck opening nor the sleeves play a role in the convertibility of the shirt.

First Wearing Mode

To convert the shirt to a first wearing mode, the first step taken by wearer 11, as shown in FIG. 3, is to unbutton the left and right panels 14 and 15 so that the front is open, and to release fasteners 19 so that the upper margin of band 18 is disconnected from the left and right panels 14 and 15 of the shirt front, the lower margin of the band being free. However, the ends of the band remained connected to the corresponding ends of rear section 17R of the shirt, so that now the band is a loop.

The wearer then, as shown in FIG. 4, raises band 18 under the left and right panels 14 and 15 and over her head and then behind her neck, as shown in FIG. 5. At this stage in the conversion, band 18 forms a yoke about the neck and partially covers the bust of the wearer. The wearer, as shown in FIG. 5, then interconnects the complementary components 20A and 20B of the connector to complete a halter, as shown in FIG. 5. This halter underlies left and right panels 14 and 15 of the shirt and is therefore visible only when the panels are open.

Because the ends of band 18 are sewn to the corresponding ends of rear section 17R of the shirt, when the band is raised, rear section 17R is then drawn under back 17 of the shirt, as shown in FIG. 7, thereby shortening the shirt to about waist length of less, creating a cape-like effect.

Figure 8:
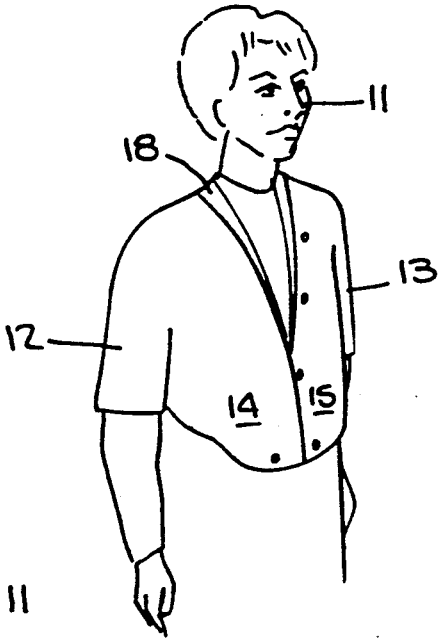
FIG. 8 shows the front of the shirt in its closed state.
Figure 9:
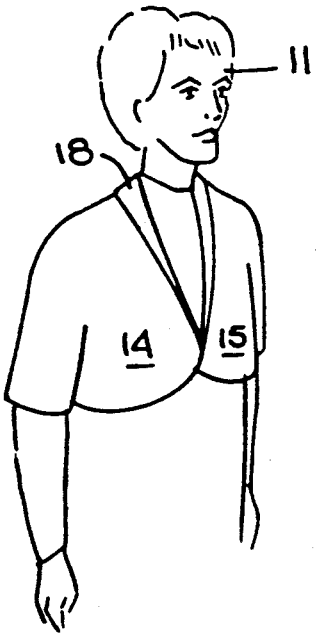
FIG. 9 illustrates how the front panels of the shirt are tucked under the halter.

FIG. 8 shows the converted shirt with the left and right panels 14 and 15 buttoned together and concealing the underlying halter, which covers the bust of the wearer, the panels being of waist length. However, in practice, as shown in FIG. 9, the left and right panels may be tucked under the halter covering the bust, so that now the appearance of the shirt is halter-like and the midriff of the wearer is exposed.

Second Wearing Mode

To convert the shirt to a second wearing mode, the left and right panels 14 and 15 of the shirt front remain partially buttoned together, and fasteners 19 are released to detach the upper margin of band 18 from these panels.

Band 18, as shown in FIG. 11, is then raised to go over the closed left and right panels 14 and 15 of the front, the band being pulled over the head and placed behind the neck to create a yoke about the neck that partially covers the bust. The components 20A and 20B of the connector are then joined together, as shown in FIG. 12, to form a halter which, as shown in FIG. 13, overlies the left and right panels of the front. Since the halter which covers the bust is shorter than the waist length left and right panels of the front, the panels, as shown in FIG. 13, extend below the halter and are partially exposed.

The wearer may therefore, as shown in FIG. 14, tuck the exposed portions of left and right panels 14 and 15 under the halter so that the overall appearance of the garment in this mode is halter-like.

Since for this conversion mode, the left and right panels of the front remain partially closed, in a modified form of convertible shirt (not shown), instead of left and right panels, a plain front may be provided of waist length, as in a T-shirt, but the back of the shirt must still be longer to form a rear section that extends below the front.

While there has been shown and described a preferred embodiment of a convertible woman's shirt in accordance with the invention, it will be appreciated that many changes and modifications may be made therein without, however, departing from the essential spirit thereof. Thus instead of a shirt of hip length, it may have the length of a mini dress that goes below the hips.

We claim:

1. A convertible woman's shirt that functions as a top when worn in combination with a skirt, slacks, shorts, a bikini or other bottom, said shirt comprising:

(a) a fabric back;

(b) a relatively short fabric front, whereby the back extends below the front to form a rear section; and (c) a rectangular fabric band extending across the rear section and joined at its ends to corresponding ends of the rear section, said band being provided with releasable fastening means to attach an upper margin of the band to a lower margin of the front, the lower margin of the band being free, so that when the fastening means are released, the band is then a loop that may be pulled over the head of the wearer and placed behind the neck to form a yoke which partially covers the bust of the wearer; and (d) a releasable connector having complementary components which are attached to lower left and right corners of the band, which components, when joined together, cause the yoke to cover the bust to create a halter.

2. A shirt as set forth in claim 1, wherein said front is formed of left and right panels provided with releasable fastener means to join the panels together, whereby when the panels are open, the band may be raised under the panels and then pulled over the head to create a halter beneath the panels.

3. A shirt as set forth in claim 1, wherein said band is of a fabric whose material contrasts with the fabric forming the front and back of the shirt.

4. A shirt as set forth in claim 1, wherein said connector is a snap type connector.

5. A shirt as set forth in claim 1, wherein said fastener means are snap fasteners.

6. A shirt as set forth in claim 1, provided with short sleeves.

7. A shirt as set forth in claim 2, wherein said fastener means for the panels are snap fasteners.

8. A shirt as set forth in claim 1, wherein said back is about hip length and said front is about waist length.

9. A shirt as set forth in claim 1, fabricated of cotton.

* * * * *